US010232925B1

(12) United States Patent
Gable et al.

(10) Patent No.: US 10,232,925 B1
(45) Date of Patent: Mar. 19, 2019

(54) SYSTEM AND METHODS FOR STEERING A MARINE VESSEL

(71) Applicant: Brunswick Corporation, Lake Forest, IL (US)

(72) Inventors: Kenneth G. Gable, Oshkosh, WI (US); Steven J. Andrasko, Oshkosh, WI (US); Michael J. Lemancik, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 160 days.

(21) Appl. No.: 15/377,510

(22) Filed: Dec. 13, 2016

(51) Int. Cl.
*B63H 25/24* (2006.01)
*B63H 21/21* (2006.01)
*B63H 25/02* (2006.01)

(52) U.S. Cl.
CPC ..... *B63H 25/24* (2013.01); *B63H 21/213* (2013.01); *B63H 25/02* (2013.01); *B63B 2718/00* (2013.01); *B63H 2025/022* (2013.01)

(58) Field of Classification Search
CPC ..... B63H 25/02; B63H 25/24; B63H 25/42; B63H 20/12; B63H 21/213; B63H 2025/022; B63H 2020/003; B63H 2025/026; B63H 21/21; B63H 11/107; B63H 11/113; B63H 25/46; B63H 11/11; B63H 2021/216; B63H 21/22; B63H 25/52; B63H 11/08; B63H 2023/062; B63H 2025/066; B63H 23/06; B63H 25/30; B63H 2025/028; B63H 25/36; B63H 5/08;
(Continued)

(56) References Cited

U.S. PATENT DOCUMENTS 6,138,596 A 10/2000 Gonring et al.
6,230,642 B1 5/2001 McKenney et al.
(Continued)

FOREIGN PATENT DOCUMENTS

JP 2739208 B2 4/1998
JP 2959044 B2 10/1999
(Continued)

OTHER PUBLICATIONS

Boattest.com, Yanmar 8LV-ZT370 Joystick, web article, last accessed Nov. 7, 2016, available at http://www.boattest.com/enginereview/Yanmar/12500050_8LVZT370Joystick.

*Primary Examiner* — Anne M Antonucci
*Assistant Examiner* — Sanjeev Malhotra
(74) *Attorney, Agent, or Firm* — Andrus Intellectual Property Law, LLP

(57) ABSTRACT

A method for steering a marine vessel powered by a marine engine and having a steerable marine device includes initiating a docking mode, and in response to initiation of the docking mode, reducing a steering ratio between input signals corresponding to steered positions of a steering wheel and output signals corresponding to desired steering angles of the marine device, such that the steering ratio is less than the steering ratio would otherwise be were the vessel in a non-docking mode. Input signals are accepted from the steering wheel, and output signals are generated based on the input signals and the reduced steering ratio. The output signals are sent to a steering actuator coupled to the marine device, which controls a position of the marine device to the desired steering angles.

18 Claims, 4 Drawing Sheets

(58) Field of Classification Search
CPC ..... G05D 1/0206; B62D 15/02; B62D 5/001; B62D 5/006; B63B 2715/00; B63B 2758/00; G05G 1/082; G05G 5/04; G05G 9/047; Y02T 10/56
USPC ..... 701/21; 114/144 R, 144 RE, 151; 440/41, 59, 63, 75, 84; 74/492
See application file for complete search history.

(56) References Cited

U.S. PATENT DOCUMENTS

| | | | | |
|---|---|---|---|---|
| 6,273,771 | B1 * | 8/2001 | Buckley | B63H 21/213 114/144 RE |
| 6,405,669 | B2 | 6/2002 | Rheault et al. | |
| 6,535,806 | B2 | 3/2003 | Millsap et al. | |
| 6,655,490 | B2 | 12/2003 | Andonian et al. | |
| 6,843,195 | B2 | 1/2005 | Watabe et al. | |
| 6,883,451 | B2 | 4/2005 | Takada et al. | |
| 6,892,661 | B2 | 5/2005 | Kishi et al. | |
| 6,892,662 | B2 | 5/2005 | Watanabe et al. | |
| 6,926,568 | B2 | 8/2005 | Mizuguchi et al. | |
| 6,994,046 | B2 | 2/2006 | Kaji et al. | |
| 7,004,278 | B2 | 2/2006 | Sugitani et al. | |
| 7,036,445 | B2 | 5/2006 | Kaufmann et al. | |
| 7,063,030 | B2 | 6/2006 | Mizutani | |
| 7,140,315 | B2 | 11/2006 | Okuyama | |
| 7,156,034 | B2 | 1/2007 | Mizutani | |
| 7,179,143 | B2 | 2/2007 | Mizuguchi et al. | |
| 7,267,069 | B2 | 9/2007 | Mizutani | |
| 7,267,587 | B2 | 9/2007 | Oguma et al. | |
| 7,270,068 | B2 | 9/2007 | Mizutani | |
| 7,311,572 | B2 | 12/2007 | Yamashita et al. | |
| 7,320,629 | B2 | 1/2008 | Okuyama | |
| 7,398,742 | B1 | 7/2008 | Gonring | |
| 7,404,369 | B2 | 7/2008 | Tracht et al. | |
| 7,422,496 | B2 | 9/2008 | Mizutani | |
| 7,452,250 | B2 | 11/2008 | Yazaki et al. | |
| 7,455,557 | B2 | 11/2008 | Mizutani | |
| 7,465,200 | B2 | 12/2008 | Mizutani | |
| 7,494,390 | B2 | 2/2009 | Mizutani | |
| 7,497,746 | B2 | 3/2009 | Okuyama | |
| 7,527,537 | B2 | 5/2009 | Mizutani | |
| 7,699,674 | B1 | 4/2010 | Wald et al. | |
| 7,769,504 | B2 | 8/2010 | Kaji | |
| 7,844,374 | B2 | 11/2010 | Mizutani | |
| 7,913,800 | B2 | 3/2011 | Graeve et al. | |
| 7,930,986 | B2 | 4/2011 | Mizutani | |
| 8,046,121 | B2 | 10/2011 | Mizutani | |
| 8,046,122 | B1 | 10/2011 | Barta et al. | |
| 8,113,892 | B1 | 2/2012 | Gable et al. | |
| 8,162,706 | B2 | 4/2012 | Mizutani et al. | |
| 8,182,396 | B2 | 5/2012 | Martin et al. | |
| 8,190,316 | B2 | 5/2012 | Kaji | |
| 8,376,792 | B2 | 2/2013 | Chiecchi | |
| 9,156,535 | B2 | 10/2015 | Mizutani | |
| 9,359,057 | B1 * | 6/2016 | Andrasko | B63H 20/12 |
| 9,522,723 | B1 * | 12/2016 | Andrasko | B63H 20/12 |
| 9,733,645 | B1 * | 8/2017 | Andrasko | G05D 1/0206 |
| 9,809,292 | B1 * | 11/2017 | Gonring | B63H 25/02 |
| 9,988,134 | B1 * | 6/2018 | Gable | B63H 20/12 |
| 2005/0170713 | A1 * | 8/2005 | Okuyama | B63H 20/12 440/59 |
| 2005/0199167 | A1 * | 9/2005 | Mizutani | B63H 25/02 114/144 R |
| 2005/0199169 | A1 * | 9/2005 | Mizutani | B63H 21/265 114/144 RE |
| 2007/0238370 | A1 * | 10/2007 | Morvillo | B63H 11/08 440/41 |
| 2008/0189001 | A1 * | 8/2008 | Morvillo | B63H 11/107 701/21 |
| 2010/0022146 | A1 * | 1/2010 | Morvillo | B63H 11/08 440/84 |
| 2010/0116190 | A1 * | 5/2010 | Ito | B63H 20/12 114/144 RE |
| 2010/0154697 | A1 * | 6/2010 | Ito | B63H 25/36 114/144 RE |
| 2010/0191397 | A1 * | 7/2010 | Nose | B63H 25/42 701/21 |
| 2011/0166724 | A1 * | 7/2011 | Hiramatsu | B63H 21/213 701/21 |
| 2012/0045951 | A1 * | 2/2012 | Washino | B63H 20/12 440/63 |
| 2012/0101670 | A1 * | 4/2012 | Morvillo | B63H 11/08 701/21 |
| 2013/0096742 | A1 * | 4/2013 | Nose | B63H 25/42 701/21 |
| 2013/0273792 | A1 * | 10/2013 | Davis | B63H 20/14 440/75 |
| 2014/0174331 | A1 | 6/2014 | Hitachi et al. | |
| 2014/0202368 | A1 * | 7/2014 | Morvillo | B63H 11/08 114/151 |
| 2014/0222260 | A1 * | 8/2014 | Anson | B63H 25/24 701/21 |
| 2015/0034001 | A1 * | 2/2015 | Clarke | B63H 25/24 114/144 R |
| 2015/0192947 | A1 * | 7/2015 | Clarke | B63H 25/24 74/492 |
| 2016/0144941 | A1 * | 5/2016 | Morvillo | B63H 11/08 114/144 R |
| 2016/0221659 | A1 * | 8/2016 | Wood | B63H 25/42 |
| 2017/0029084 | A1 * | 2/2017 | Burk | B63H 25/14 |
| 2017/0029085 | A1 * | 2/2017 | Burk | B63H 25/24 |
| 2017/0121004 | A1 * | 5/2017 | Clarke | B63H 25/24 |
| 2017/0225761 | A1 * | 8/2017 | Morvillo | B63H 11/08 |
| 2017/0247096 | A1 * | 8/2017 | Morvillo | B63H 11/107 |
| 2017/0283027 | A1 * | 10/2017 | Burk | B63H 25/14 |
| 2018/0093749 | A1 * | 4/2018 | Wood | B63H 25/42 |

FOREIGN PATENT DOCUMENTS

| | | | |
|---|---|---|---|
| JP | 3232032 | B2 | 11/2001 |
| JP | 4409963 | B2 | 2/2010 |
| JP | 2016539861 | A | 12/2016 |

* cited by examiner

66

| WHEEL ANGLE | MARINE DEVICE ANGLE |
|---|---|
| 5 | A |
| 10 | B |
| 20 | C |
| 50 | D |

68

| WHEEL ANGLE | MARINE DEVICE ANGLE |
|---|---|
| 5 | F(A) |
| 10 | F(B) |
| 20 | F(C) |
| 50 | F(D) |

SYSTEM AND METHODS FOR STEERING A MARINE VESSEL

FIELD

The present disclosure relates to systems and methods for steering a marine vessel powered by a marine engine and having a steerable marine device.

BACKGROUND

U.S. Pat. No. 6,138,596, which is incorporated herein by reference, discloses a hydraulic damper for a steering system, such as that of a boat or watercraft. A manually movable steering mechanism, such as a steering wheel, is connected to a piston and cylinder combination in such a way that rotation of the steering wheel causes relative movement between the piston and cylinder. Hydraulic fluid is disposed within the cylinder in such a way that movement between the cylinder and piston requires the hydraulic fluid to move from one portion of the cylinder to another portion of the cylinder. This fluid movement is conducted through a conduit which can be external to the cylinder or internal to the cylinder and extending through the piston.

U.S. Pat. No. 6,273,771, which is incorporated herein by reference, discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,699,674, which is incorporated herein by reference, discloses a steering mechanism that connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

U.S. Pat. No. 8,046,122, which is incorporated herein by reference, discloses a control system for a hydraulic steering cylinder utilizing a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the present invention in order to allow accurate and controlled movement of a steering device in response to movement of a steering wheel of a marine vessel.

U.S. Pat. No. 8,113,892, which is incorporated herein by reference, discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a method is disclosed for steering a marine vessel powered by a marine engine having a steerable marine device. The method includes initiating a docking mode, and in response to initiation to the docking mode, reducing a steering ratio between input signals corresponding to steered positions of a steering wheel and output signals corresponding to steering angles of the steering device. The steering ratio is reduced such that the steering ratio is less than the steering ratio would otherwise be were the vessel in a non-docking mode. The method includes accepting the input signals from the steering wheel and generating the output signals based on the input signals and the reduced steering ratio. The method includes sending the output signals to a steering actuator coupled to the marine device and controlling a position of the marine device to the desired steering angles.

In another example of the present disclosure, a system is disclosed for steering a marine vessel powered by a marine engine. A steerable marine device is coupled to the vessel and rotatable to desired steering angles to affect a direction of the vessel. A steering wheel having a sensor that generates input signals corresponding to steered positions of the steering wheel is also provided. A control module is provided in signal communication with the steering wheel and generates output signals based on the input signals. A steering actuator is in signal communication with the control module and moves the marine device to the desired steering angles in response to the output signals. In response to initiation of a docking mode, the control module reduces a steering ratio between the input signals and the output signals, such that the steering ratio is less than the steering ratio would otherwise be were the vessel in a non-docking mode, and generates the output signals based on the input signals and the reduced steering ratio.

BRIEF DESCRIPTION OF THE DRAWINGS

Examples of systems and methods for enhancing features of a marine propulsion system are described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f) only if the terms "means for" or "step for" are explicitly recited in the respective limitation.

Figure 1:
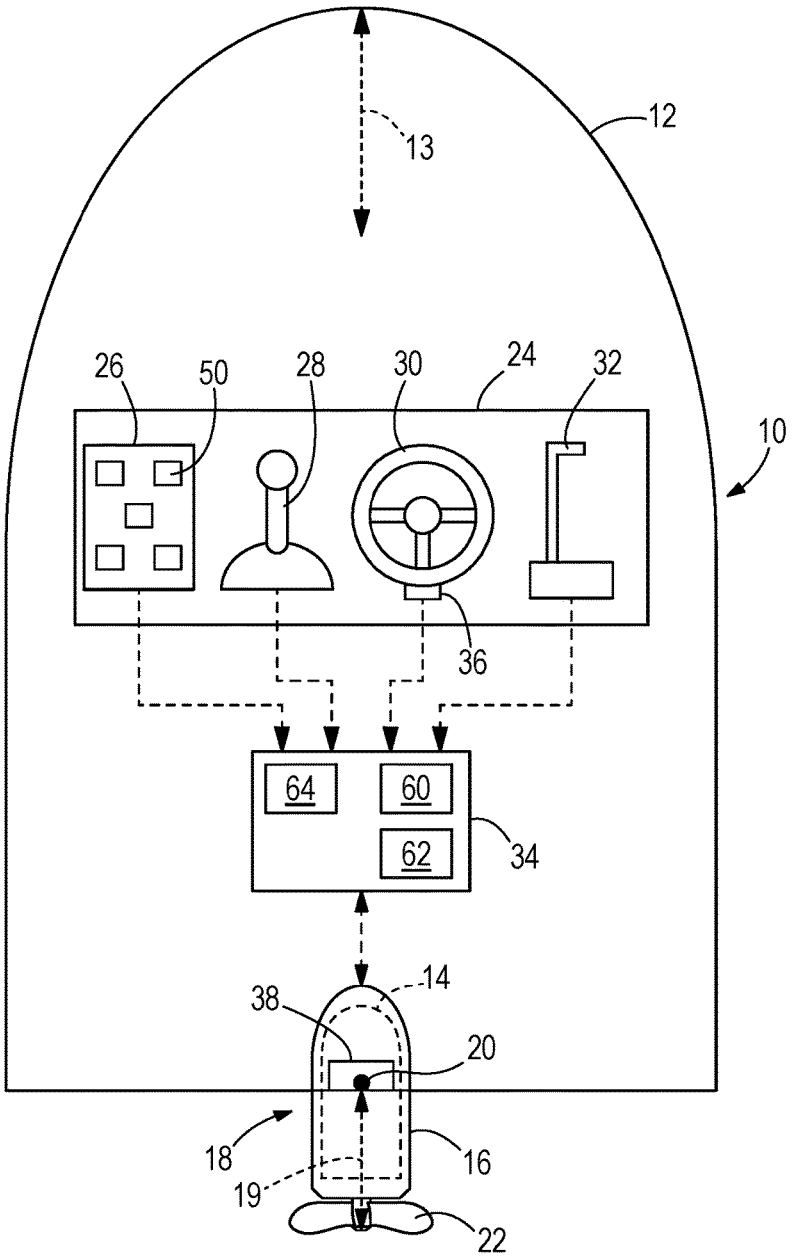
FIG. 1 is a schematic showing one example of a marine vessel and a control system associated therewith.

FIG. 1 illustrates a system 10 for steering a marine vessel 12, in this example powered by a marine engine 14, which is part of an outboard motor 16. The outboard motor 16 is a steerable marine device 18 that is coupled to the vessel 12 and rotatable about a vertical steering axis 20 to desired angles to affect the direction of travel of the vessel 12. However, in other examples, the engine 14 and steerable marine device 18 need not be provided as a unit, such as the case in which the steerable marine device 18 is a pod drive, stern drive, rudder, or any other steerable marine device capable of affecting the direction of the vessel 12. It should also be noted that an engine need not be the power-supplying device for the marine vessel 12, but instead an electric motor or an engine/motor combination could be utilized. Additionally, although the outboard motor 16 shown herein is provided with a propeller 22 for providing a thrust force to propel the vessel 12, other devices could be used, such as, but not limited to, an impeller or a jet drive.

The control system 10 shown herein also includes an operator console 24, which may be located at a helm of the vessel 12. The operator console 24 includes a keypad 26, a joystick 28, a steering wheel 30, and a throttle/shift lever 32. Any of the keypad 26, joystick 28, or steering wheel 30 can be used to provide steering commands to a control module 34, which in turn communicates with the outboard motor 16 to rotate it about its steering axis 20, as will be described further herein below. The joystick 28 and the throttle/shift lever 32 can also be used to provide commands to the outboard motor 16 regarding gear selection and thrust magnitude. The control algorithms for performing such steering control, throttle control, and shift control are well known, and are described in some of the above-incorporated patents. In the present example, the steering wheel 30 has a sensor 36 that generates input signals corresponding to steering positions of the steering wheel 30. The sensor 36 may be, for example, a rotary encoder, as known to those having ordinary skill in the art. The sensor 36 sends the input signals, corresponding to the steered positions of the steering wheel 30, to the control module 34, which is in signal communication with the steering wheel 30. The control module 34 then generates output signals based on the input signals, which output signals are sent to the steerable marine device 18. Further detail regarding the relationship between the input signals and output signals will be described herein below.

The control module 34 is programmable and includes a processing system (e.g. processor 60) and a storage system (e.g. memory 62). The control module 34 can be located anywhere in the system 10 and/or located remote from the system 10 and can communicate with various components of the vessel 12 via a peripheral interface and wired and/or wireless links, as will be explained further herein below. Although FIG. 1 shows one control module 34, the system 10 can include more than one control module. Portions of the method disclosed herein below can be carried out by a single control module or by several separate control modules. For example, the system can have a control module located at or near a helm of the marine vessel and can also have control module(s) located at or near the steerable marine device 18. If more than one control module is provided, each can control operation of a specific device or sub-system on the marine vessel 12.

In some examples, the control module 34 may include a computing system that includes a processing system, storage system, software, and input/output (I/O) interface 64 for communicating with peripheral devices. The systems may be implemented in hardware and/or software that carries out a programmed set of instructions. For example, the processing system loads and executes software from the storage system, such as software programmed with a method for steering a vessel, which directs the processing system to operate as described herein below in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The control module 34 communicates with one or more components of the control system 10 via the I/O interface 64 and a communication link, which can be a wired or wireless link, and is shown schematically herein by dashed lines. The control module 34 is capable of monitoring and controlling one or more operational characteristics of the control system 10 and its various subsystems by sending and receiving control signals via the communication link. In one example, the communication link is a controller area network (CAN) bus, but other types of links could be used.

The control module 34 and various associated software modules functionally convert input signals, such as but not limited to vessel control signals, to output signals, such as but not limited to actuator control signals, according to the computer executable instructions. Each of the input signals can be split into more than one branch, depending on how many functions are to be carried out and/or how many actuators are to be controlled with each of the input signals. The input signals may be fed to several software modules within the control module 34 through branch signals. The exact signals input into the software modules can be taken directly from the corresponding control input device or sensor, or could be pre-processed in some way, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal.

The provided description of the control module 34 is conceptual and should be interpreted generally, as those skilled in the art will recognize many ways to implement such a control module. These include implementation using a digital microprocessor that receives input signals or branch signals and performs a calculation using the input signals to produce the corresponding output signals or actuator control signals. Also, analog computers may be used, which comprise circuit elements arranged to produce the desired outputs. Furthermore, look-up tables containing predetermined or calibrated data points may be stored in any fashion to provide the desired output corresponding to a given input signal.

One device for providing such input signals is a steering actuator 38, which is in signal communication with the control module 34 via the communication link. The steering actuator 38 may be a hydraulic piston-cylinder combination, a rack and pinion device, or any other steering actuator for a steerable marine device known to those having ordinary skill in the art. In the example shown, the steering system is therefore a steer-by-wire system, in which no mechanical linkages are provided between the operator console 24 and the steering actuator 38. Rather, the steering actuator moves the marine device 18 to desired steering angles in response to the output signals from the control module 34. The desired steering angles can be defined as an angle of the longitudinal centerline 19 of the steerable marine device 18 with respect to an imaginary longitudinal centerline 13 of the vessel 12, as the marine device 18 rotates about its steering axis 20 with respect to the vessel 12. Of course, other ways of defining the steering angle of the marine device 18 are contemplated as being within the scope of the present disclosure.

Figures 2, 3A, 3B:
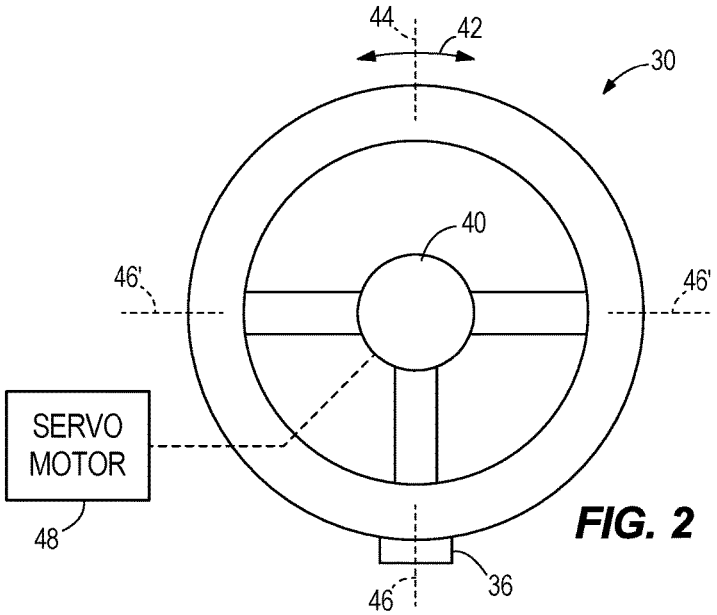
FIG. 2 illustrates one example of a steering wheel for the marine vessel control system.
FIGS. 3A and 3B illustrate examples of steering angle maps according to the present disclosure.

FIG. 2 illustrates a top view of the steering wheel 30. As mentioned above, the steering wheel 30 can be provided with a sensor 36, such as an encoder or other type of transducer which generates input signals (to be sent to the control module 34) corresponding to steered positions of the steering wheel 30. The steering wheel 30 is shown in a zero degree position, in which no rotation of the marine device 18 is requested, and the vessel 12 is therefore steered straight ahead. The steering wheel 30 can be rotated about its hub 40 as generally shown by the arrow 42. In one embodiment, a center line 44 is depicted as a dashed line and is directed straight ahead (upward with respect to the plane of the drawing), which corresponds to a request for movement of the vessel 12 straight ahead. Rotation of the steering wheel 30 as shown by the arrow 42 may occur in a clockwise or counterclockwise manner, as is conventionally known. In the embodiment shown, when the steering wheel 30 is rotated counterclockwise by a given number of turns until the center line 44 meets a stop/lock line 46, a left stop condition is met and the steering wheel 30 will no longer rotate in the counterclockwise direction. Similarly, rotation of the steering wheel 30 in a clockwise direction by a given number of turns until the center line 44 meets the stop/lock line 46 corresponds to a right stop in which the steering wheel 30 may no longer be rotated in the clockwise direction. The number of turns in the counterclockwise direction from the neutral, centered position shown in FIG. 2 to the position where the steering wheel 30 is stopped, plus the number of turns in the clockwise direction from the neutral, centered position to where the steering wheel 30 is stopped, defines a number of turns from lock-to-lock of the steering wheel 30.

Because the control system 10 is a steer-by-wire system, it is desirable to provide physical feedback force required from the operator to turn the steering wheel 30 over what would otherwise be required were no counteracting force provided. Such power steering systems are known to those having ordinary skill in the art, and in the present disclosure include a servo motor 48 coupled to the hub 40 of the steering wheel 30 to provide resistance to rotation thereof. The servo motor 48 provides a resistance to turning about the hub 40 that is able to be overcome by the operator before the stop position is reached, in order that the operator feels as though he is turning against the force of water acting on the marine device 18; and the servo motor 48 provides a resistance that is not able to be overcome by the operator when the stop/lock line 46 is reached, thereby preventing further turning of the steering wheel 30. In other examples, the steering wheel 30 can be provided with a device containing magnetorheological fluid, which, when a magnetic field is applied, provides variable resistance to turning of the hub 40. In other examples, disc brake-type clutches can be used to stop the steering wheel 30 from rotating when the stop/lock line 46 is reached.

As is known, the sensor 36 in the steering wheel 30 may include an encoder that produces an electrical signal for input to the control module 34. FIG. 3A shows one example of a steering angle input-output map 66, which relates input signals from the steering wheel 30 to output signals to the steering actuator 38. Such input signals are shown in the left hand column of FIG. 3A as "wheel angle," and therefore represent a steered angle of the steering wheel 30. Using a map stored in its memory 62, the control module 34 correlates the input signals to output signals corresponding to desired steering angles of the marine device 18. The output signals are shown in the right hand column of the table in FIG. 3A as "marine device angle." The tabular format of the input-output map 66 depicted herein is merely exemplary; in other examples, the control module 34 relates the input signals to the output signals by using a graph, map, look-up table, equation, or other input-output algorithm. These output signals are sent from the control module 34 to the steerable marine device 18, which interprets the signals and actuates the steering actuator 38 to provide the desired steering angles. Note that for values between 5 and 10 degrees of actuation of the steering wheel 30, or between 10 and 20 degrees, etc., a prescribed form of interpolation (e.g., linear interpolation) can be used to determine the corresponding output. Note that the input-output map 66 can include much higher values and can also include negative values for distinguishing between clockwise and counter-clockwise rotation of the steering wheel 30 and the marine device 18. For example, the input-output map 66 should include values up to the stop/lock line 46 of the steering wheel 30, which is correlated to a maximum steering angle of the marine device 18.

The input signals and output signals shown in the table of FIG. 3A inherently have a steering ratio, which may be the ratio of the physical quantity related to the input signals (i.e., the number of turns of the steering wheel 30) to the physical quantity related to the output signals (i.e., the rotational angle of the marine device 18). This steering ratio may be linear, such that the ratio 5:A is same as the ratio 10:B, is the same as the ratio 20:C, is the same as the ratio 50:D, etc. In other examples, the steering ratio may vary according to different functions, may incorporate cut-off limits, and/or may depend on a measured value such as vessel speed, as is known to those having ordinary skill in the art. The steering ratio may be defined between the physical quantities corresponding to the input and output signals, or may be defined between the values of the input and output signals themselves. In one example, the steering angle input-output map 66 shown in the table of FIG. 3A is used in a normal, non-docking mode of the control system 10, wherein the alternative docking mode will be described below.

An operator may wish to initiate a docking mode when in close quarters and/or when docking the vessel 12 near a dock, pier, or other object. While undertaking such a task, it is often advantageous for the operator to be able to steer the steering wheel 30 from lock to lock as fast as possible. For example, maneuvers around a dock often call for hard-oversteering in one direction in forward gear, followed by hard-oversteering in the opposite direction in reverse gear. This sequence is often repeated numerous times in quick succession in order to move the vessel 12 in a desired manner. By way of example and referring to FIG. 2, if the system is set up with a nominal 2.75 turns from a centered, neutral position (with center line 44 pointing straight ahead) to a stop/lock position (with center line 44 aligned with stop/lock line 46) each forward or reverse gearshift is preceded by 5.5 turns of the steering wheel 30. In order to assist the vessel operator while steering from lock to lock multiple times, hydraulic steering has been provided to decrease the required steering forces. Additionally, the use of a steering wheel knob is common, which allows the operator to grip the knob and turn the steering wheel 30 as fast as possible from lock to lock. This single-handed motion allows the operator to keep his or her other hand on the throttle/shift lever 32, which aids in increasing the possible speed of the cycle from lock to lock. However, if the steering wheel 30 is not equipped with a steering wheel knob, the force provided by the servo motor 48 is high enough that the operator will need to employ a hand-over-hand technique to steer the steering wheel 30 from lock to lock.

On vessels with multiple propulsion devices, various joystick docking systems have been developed, which employ independent drive articulation to achieve translational (i.e., sideways) movement of the vessel 12. However, on single propulsion device vessels, where there is no second thrust source to assist with translational maneuvers, such vessel movement may be difficult, if not impossible. The present inventors have therefore developed a system 10 in which, in response to initiation of a docking mode, the control module 34 reduces a steering ratio between the input signals and the output signals, such that the steering ratio is less than the steering ratio would otherwise be were the vessel 12 in a non-docking mode. The control module 34 thereafter generates the output signals based on the input signals and the reduced steering ratio. Thus, the input from the steering wheel 30 can be decreased from requiring multiple turns between center line 44 being in the neutral, centered position to center line 44 being aligned with stop/lock line 46, to requiring only one turn (or a fraction of a turn) between center line 44 being in the neutral, centered position to center line 44 being aligned with stop/lock line 46, in order to command the marine device 18 to its full steering angle range. As one example, the steering wheel 30 need only be turned plus or minus ninety degrees (plus or minus one quarter turn) from having center line 44 in the neutral, centered position in order to command such a full steering angle range of the marine device 18 (e.g., plus or minus thirty degrees from being aligned with the longitudinal centerline 13 of the vessel). See positions 46' in FIG. 2. Although the present system and method are particularly helpful with single-propulsion device systems, the system and method disclosed herein could also be used with multiple-propulsion device systems. By requiring an operator to turn the steering wheel 30 by fewer degrees than usual to obtain full actuation range of the marine device 18, the speed in which docking maneuvers can be accomplished is greatly increased, and the effort involved is minimized. Shifting of the marine engine 14 can also take place at a quicker pace, aiding in more precise movements during close quarter maneuvering.

Figure 4:
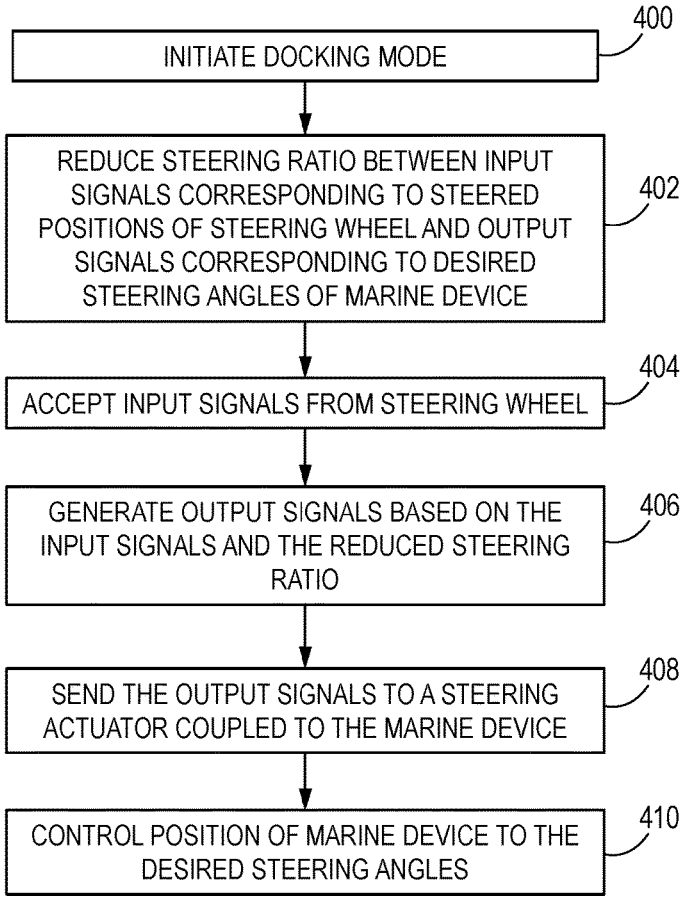
FIG. 4 illustrates one example of a method for steering a marine vessel.

Now turning to FIG. 4, one method for steering a marine vessel 12 powered by a marine engine 14 and having a steerable marine device 18 will be disclosed. As shown at 400, the method includes initiating a docking mode. In response to initiation of the docking mode, as shown at 402, the method includes reducing a steering ratio between input signals corresponding to steered positions of the steering wheel 30 and output signals corresponding to desired steering angles of the marine device 18, such that the steering ratio is less than the steering ratio would otherwise be were the vessel 12 in a non-docking mode. As shown at 404, the method includes accepting the input signals from the steering wheel 30. As shown at 406, the method includes generating the output signals based on the input signals and the reduced steering ratio. As shown at 408, the method includes sending the output signals to a steering actuator 38 coupled to the marine device 18. At shown at 410, the method includes controlling the position of the marine device 18 to the desired steering angles.

Figure 5:
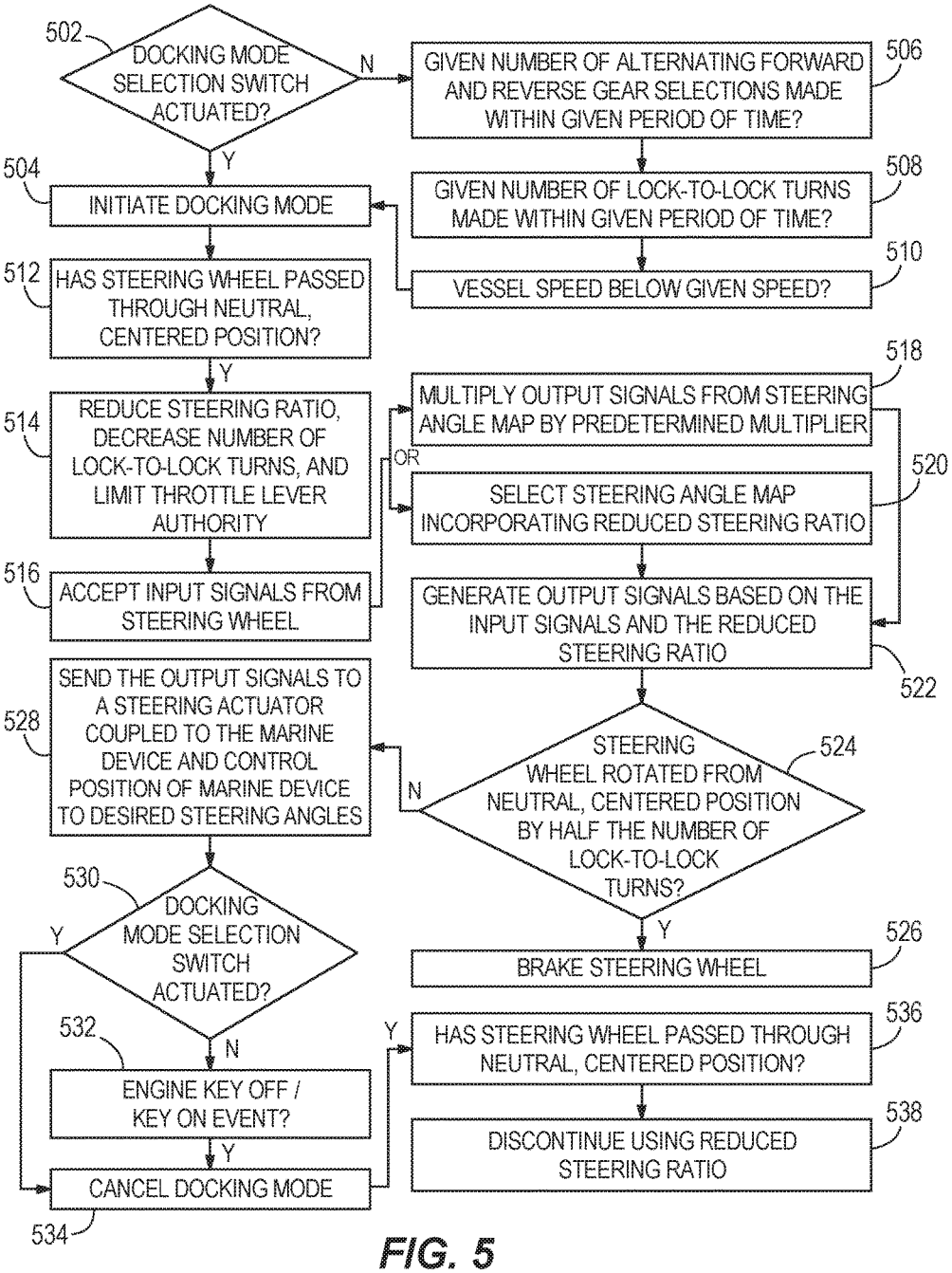
FIG. 5 illustrates another example of a method for steering a marine vessel.

FIG. 5 shows another, more detailed, example of a method for steering a marine vessel 12 according to the present disclosure. As shown at 502, the method may include determining whether a docking mode selection switch has been actuated. For example, with brief reference to FIG. 1, the docking mode selection switch 50 may be provided on the keypad 26 at the operator console 24. Note that the keypad 26 may alternatively be a touchscreen, and the docking mode selection switch 50 may alternatively be an icon on the touch screen. In other examples, the docking mode selection switch 50 may be provided other than at the keypad 26, such as near the steering wheel 30. In still other examples, the docking mode selection switch may be actuated in response to a voice command, cursor selection of a computer screen icon, or any other mode of inputting commands to a control module 34 known to those having ordinary skill in the art. As show at 504, the method may include initiating the docking mode in response to selection of a docking mode option by an operator of the vessel 12, such for example by actuation of the docking mode switch 50.

Alternatively, if no docking mode selection switch 50 is provided, or if a switch 50 is provided but has not been actuated, the method may include initiating the docking mode in response to determining that a given number of alternating forward and reverse gear selections for the marine engine 14 have been made within a given period of time, as shown at 506. By way of example only, the given number of alternating forward and reverse gear selections may be three, and the given period of time may be one minute. The method may further include, as shown at 508, initiating the docking mode in response to additionally determining that a given number of lock to lock turns (e.g., two) of the steering wheel 30 have been made within the given period of time (e.g., one minute). Referring to 510, the method may further comprise initiating the docking mode in response to additionally determining that a speed of the vessel 12 is below a given speed, such as for example five miles per hour. Note that the control module 34 may require that each of 506, 508, and 510 are true before the docking mode will be initiated at 504. In other examples, the control module 34 may require that only one or two of the conditions at 506, 508, and 510 are met before the docking mode will be initiated. In yet another example, the control module 34 may require that the docking mode selection switch is first actuated, as shown at 502, and also that the vessel speed is below a given speed, as shown at 510, before the docking mode will be initiated.

Once the docking mode has been initiated at 504, the method may further include waiting until the steering wheel 30 has passed through the neutral, centered position (i.e., with center line 44 pointing straight ahead and centerline 19 of marine device 18 aligned with centerline 13 of vessel 12) after initiation of the docking mode before utilizing the reduced steering ratio to determine the output signals. Requiring this step, shown at 512, will ensure that the marine device 18 is not unexpectedly actuated to a different steering angle upon initiation of the docking mode, despite the fact that the operator has not moved the steering wheel 30, which could potentially throw occupants of the vessel 12 off balance. If the answer at 512 is no, the control module 34 may initiate a timer that starts from the time the docking mode was initiated. If the steering wheel 30 has not passed through the neutral, centered position by a given time, the method may include cancelling the docking mode and returning the determination at 502 and/or 506. On the other hand, once the steering wheel 30 has passed through the neutral, centered position after initiation of the docking mode, the method continues to 514.

At 514, the method includes reducing the steering ratio between the input signals corresponding to steered positions of the steering wheel 30 and the output signals corresponding to desired steering angles of the marine device 18. The algorithm at 514 may further comprise decreasing a number of lock-to-lock turns of the steering wheel 30 in response to initiation of the docking mode, such that the number of lock-to-lock turns is less than the number of lock-to-lock turns would otherwise be were the vessel 12 in the non-docking mode. This provides feedback to the operator as the steering wheel 30 is turned that indicates the steerable marine device 18 has been rotated to its steering angle limits. In other words, the control module 34 dynamically changes the end stops of the steering wheel 30 once the system 10 is in the docking mode. For example, with reference to FIG. 2, the control module may define the end stops at stop/lock lines 46' on either side of the center line 44. The control module 34 can do so by way of a steering map or table, wherein as the steering wheel 30 approaches a newly-defined end stops at stop/lock lines 46', the control module 34 brakes the steering wheel 30. For example, the method may include braking the steering wheel 30 once the steering wheel 30 has been rotated from having the center line 44 in the neutral, centered position by half the number of newly-defined lock-to-lock turns. The control module 34 can receive a signal from the sensor 36 that tells the control module 34 the position of the steering wheel 30, and when that position reaches the newly-defined stop/lock line 46', the control module 34 sends a signal to the servo motor 48 to prevent further turning of the steering wheel 30. In another example, the steering wheel 30 can be provided with its own processor, and once the given number of turns from lock-to-lock has been made, as determined by the steering wheel's processor or by the control module 34, the steering wheel 30 can brake itself.

In yet another example, the method may include limiting an authority of the throttle/shift lever 32 that controls a position of a throttle valve of the marine engine 14 in response to initiation to the docking mode. For example, movement of the throttle/shift lever 32 can correspond to lesser opening of the throttle valve than that to which it would otherwise correspond were the vessel in the non-docking mode. This can provide the operator with greater control over the speed of the vessel 12 while accomplishing docking maneuvers.

Continuing to 516, the method may further include accepting input signals from the steering wheel 30, such as from the sensor 36. Thereafter, the control module 34 may accomplish reduction of the steering ratio in various ways. As shown at 518, the method may include multiplying the output signals from a steering angle map by a predetermined multiplier in response to initiation of the docking mode prior to sending the output signals to the steering actuator 38. For example, if a memory 62 of the control module 34 contains a steering angle map that correlates the output signals to the input signals, as shown in FIG. 3A, the control module 34 may simply multiply the output signals determined from the map by a multiplier, such as, for example, ten, prior to sending the output signals to the steering actuator 38. Alternatively, a memory 62 of the control module 34 may contain steering angle maps that correlate the output signals to the input signals, and the control module 34 may select a steering angle map incorporating the reduced steering ratio in response to initiation to the docking mode. This option is shown at 520. Referring briefly to FIG. 3B, one example of such a steering angle input-output map 68 incorporating the reduced steering ratio is provided. Similar to the steering angle input-output map 66 for use in the non-docking mode provided in FIG. 3A, or for use in the docking mode with application of a multiplier, the steering angle input-output map 68 shown in FIG. 3B includes a table having a left hand column corresponding to the input signals ("wheel angle"). However, the right hand column of the table in FIG. 3B has been modified, such that the values of the output signals ("marine device angle") are functions of the output signals in the input-output map 66 used for the non-docking mode. For example, the functions could incorporate a simple multiplier, or could define a linear relationship, an exponential relationship, or any other type of relationship desired by the calibrator. The functions are programmed such that the steering angle ratios in the input-output map 68 of FIG. 3B are less the steering angle ratios in the input-output map 66 of FIG. 3A. In other words, the ratio of 5:F(A) is less than the ratio of 5:A, the ratio of 10:F(B) is less than the ratio of 10:B, and so forth. Although simple input-output maps 66, 68 are shown in FIGS. 3A and 3B, note that either or both of the maps could instead be charts or graphs, incorporating for example gull-wing or bell-shaped relationships between the input signals and the output signals.

Whether the steering ratio is reduced according to the algorithm of 518 or 520, both methods next include generating output signals based on the input signals and the reduced steering ratio, as shown at 522. As described herein above, the method may thereafter include determining whether the steering wheel 30 has been rotated from having center line 44 in the neutral, centered position by half the number of lock-to-lock turns, as shown at 524. If so, the method may include braking the steering wheel, as shown at 526, according to any of the above-described methods. So long as the stop/lock line 46' has not yet been encountered, the method includes sending the output signals to the steering actuator 38 coupled to the marine device 18 and controlling the position of the marine device 18 to the desired steering angles, as shown at 528. Once the steering wheel 30 is braked, the input signal corresponding to the stop/lock line 46' is used to generate an output signal that commands the marine device 18 to its maximum achievable steering angle.

Of course, the docking mode may also be cancelled. As shown at 530, the method may include determining whether the docking mode selection switch 50 has been actuated. The method may also include, as shown at 532, determining whether a key off/key on event of the marine engine 14 has occurred. If either of the determinations at 530 and 532 is true, the method may continue to 534, where the docking mode will be canceled. In still other examples, the docking mode may be cancelled in response to the operator selecting a speed for the vessel via the throttle/shift lever 32 that is greater than a threshold speed. As shown at 536, the control module 34 will wait until the center line 44 of the steering wheel 30 has passed through the neutral, centered position after cancellation of the docking mode before discontinuing utilizing the reduced steering ratio to determine the output signals. Again, the control module 34 could utilize a timer for such a determination. Once the center line 44 of the steering wheel 30 has passed through the neutral, centered position after cancellation of the docking mode, the method may continue to 538, and includes discontinuing using the reduced steering ratios. In other words, the control module 34 would thereafter use the steering angle input-output map 66 shown in FIG. 3A, without any multiplier, to determine subsequent steering angles for the marine device 18. Again, waiting until the center line 44 of the steering wheel 30 has passed through the neutral, centered position (with both steering wheel 30 and marine device 18 pointed straight ahead) before discontinuing using the reduced steering ratios prevents the marine device 18 from rotating to a position unexpectedly, without any input from the operator.

By way of remapping of the steering angle inputs and outputs, steering actuation from lock-to-lock can now be accomplished in less time, with less motion and effort required on the part of the vessel operator. The steering can easily be managed by the operator using only one hand, while his or her other hand remains on the throttle/shift lever 32 for easier throttle and shift control.

In the above description certain terms have been used for brevity, clarity and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A method for steering a marine vessel powered by a marine engine and having a steerable marine device, the method comprising:

initiating a docking mode;

in response to initiation of the docking mode, reducing a steering ratio between input signals corresponding to steered positions of a steering wheel and output signals corresponding to desired steering angles of the marine device, such that the steering ratio is less than the steering ratio would otherwise be were the marine vessel in a non-docking mode;

decreasing a number of lock-to-lock turns of the steering wheel in response to initiation of the docking mode, such that the number of lock-to-lock turns is less than the number of lock-to-lock turns would otherwise be were the marine vessel in the non-docking mode;

accepting the input signals from the steering wheel;

generating the output signals based on the input signals and the reduced steering ratio;

sending the output signals to a steering actuator coupled to the marine device and controlling a position of the marine device to the desired steering angles.

2. The method of claim 1, wherein the reduced steering ratio in the docking mode is linearly related to the steering ratio in the non-docking mode.

3. The method of claim 1, further comprising braking the steering wheel once the steering wheel has been rotated from a neutral, centered position by half the number of lock-to-lock turns.

4. The method of claim 1, further comprising waiting until the steering wheel has passed through a neutral, centered position after initiation of the docking mode before utilizing the reduced steering ratio to generate the output signals.

5. The method of claim 4, further comprising:

cancelling the docking mode; and waiting until the steering wheel has passed through the neutral, centered position after cancellation of the docking mode before discontinuing utilizing the reduced steering ratio to generate the output signals.

6. The method of claim 5, further comprising cancelling the docking mode in response to a key-off/key-on event of the marine engine.

7. The method of claim 1, further comprising initiating the docking mode in response to determining that a given number of alternating forward and reverse gear selections for the marine engine have been made within a given period of time.

8. The method of claim 7, further comprising initiating the docking mode in response to additionally determining that a given number of lock-to-lock turns of the steering wheel have been made within the given period of time.

9. The method of claim 8, further comprising initiating the docking mode in response to additionally determining that a speed of the marine vessel is below a given speed.

10. The method of claim 1, further comprising initiating the docking mode in response to selection of a docking mode option by an operator of the marine vessel.

11. The method of claim 1, further comprising limiting an authority of a throttle lever that controls a position of a throttle valve of the marine engine in response to initiation of the docking mode.

12. A system for steering a marine vessel powered by a marine engine, the system comprising:

a steerable marine device coupled to the marine vessel and rotatable to desired steering angles to affect a direction of the marine vessel;

a steering wheel having a sensor that generates input signals corresponding to steered positions of the steering wheel;

a control module in signal communication with the steering wheel that generates output signals based on the input signals; and a steering actuator in signal communication with the control module that moves the marine device to the desired steering angles in response to the output signals;

wherein in response to initiation of a docking mode, the control module reduces a steering ratio between the input signals and the output signals, such that the steering ratio is less than the steering ratio would otherwise be were the marine vessel in a non-docking mode, and generates the output signals based on the input signals and the reduced steering ratio; and wherein the control module decreases a number of lock-to-lock turns of the steering wheel in response to initiation of the docking mode, such that the number of lock-to-lock turns is less than the number of lock-to-lock turns would otherwise be were the marine vessel in the non-docking mode.

13. The system of claim 12, wherein the control module brakes the steering wheel once the steering wheel has been rotated from a neutral, centered position by half the number of lock-to-lock turns.

14. The system of claim 13, wherein the steering wheel comprises a servo motor, and the control module sends a signal to the servo motor to prevent further turning of the steering wheel once the steering wheel has been rotated from the neutral, centered position by half the number of lock-to-lock turns.

15. The system of claim 12, wherein a memory of the control module contains a steering angle map that correlates the output signals to the input signals, and wherein the control module multiplies the output signals from the steering angle map by a predetermined multiplier in response to initiation of the docking mode, prior to sending the output signals to the steering actuator.

16. The system of claim 12, wherein a memory of the control module contains steering angle maps that correlate the output signals to the input signals, and wherein the control module selects a steering angle map incorporating the reduced steering ratio in response to initiation of the docking mode.

17. The system of claim 12, further comprising a docking mode selection switch configured to initiate the docking mode upon actuation by an operator.

18. The system of claim 12, wherein the steerable marine device is an outboard motor that incorporates the marine engine.

* * * * *